US009961982B2

(12) United States Patent
Chevalier et al.

(10) Patent No.: US 9,961,982 B2
(45) Date of Patent: May 8, 2018

(54) DEVICE FOR PACKAGING AND APPLYING A LIQUID COMPOSITION

(71) Applicant: L V M H RECHERCHE, F-Saint Jean de Braye (FR)

(72) Inventors: Marc Chevalier, Franconville (FR); Jean-François Tranchant, Marigny-les-usages (FR); Emilie Gombart, Orleans (FR); Myriam Chevalier, Boigny-sur-bionne (FR)

(73) Assignee: LVMH Recherche, Saint Jean De Braye (FR)

( * ) Notice: Subject to any disclaimer, the term of this patent is extended or adjusted under 35 U.S.C. 154(b) by 0 days. days.

(21) Appl. No.: 15/107,539

(22) PCT Filed: Dec. 9, 2014

(86) PCT No.: PCT/FR2014/053226
§ 371 (c)(1),
(2) Date: Jun. 23, 2016

(87) PCT Pub. No.: WO2015/101728
PCT Pub. Date: Jul. 9, 2015

(65) Prior Publication Data

US 2016/0316889 A1 Nov. 3, 2016

(30) Foreign Application Priority Data

Dec. 30, 2013 (FR) ..... 13 63721

(51) Int. Cl.
*A45D 34/04* (2006.01)
*A45D 40/26* (2006.01)

(52) U.S. Cl.
CPC ..... *A45D 40/267* (2013.01); *A45D 34/045* (2013.01); *A45D 40/265* (2013.01)

(58) Field of Classification Search
CPC combination set(s) only.
See application file for complete search history.

(56) References Cited

U.S. PATENT DOCUMENTS 7,530,752 B2 * 5/2009 Gueret ..... A45D 40/267 401/122

FOREIGN PATENT DOCUMENTS

| | | |
|---|---|---|
| EP | 1 600 079 A1 | 11/2005 |
| EP | 1 847 254 A1 | 10/2007 |
| FR | 2 947 432 A1 | 1/2011 |

OTHER PUBLICATIONS

International Search Report Application No. PCT/FR14/053226 reported on Feb. 3, 2015.

* cited by examiner

*Primary Examiner* — David Walczak
(74) *Attorney, Agent, or Firm* — Miller, Matthias & Hull LLP

(57) ABSTRACT

Device for packaging and applying a liquid composition comprising solid particles that are sensitive to a magnetic field, comprising a container intended to contain the composition; an applicator that is able to be mounted on the container and comprises a stem and an applicator head secured to the stem, the stem and the head being designed to be inserted into the container when the applicator is mounted on the container; and a stem cleaning member disposed in the container. The stem comprises a magnetic part that is able to generate a magnetic field suitable for attracting and keeping some of the solid particles on the stem, in a rest position, the magnetic part extending over a part of a region of the stem that extends between the head and the cleaning member when the applicator is mounted on the container.

18 Claims, 6 Drawing Sheets

DEVICE FOR PACKAGING AND APPLYING A LIQUID COMPOSITION

CROSS-REFERENCE TO RELATED APPLICATION

This Application is a 35 USC § 371 US National Stage filing of International Application No. PCT/FR2014/053226 filed on Dec. 9, 2014, and claims priority under the Paris Convention to French Patent Application No. 13 63721 filed on Dec. 30, 2013.

FIELD OF THE DISCLOSURE

The present invention relates to a device for packaging and applying a liquid composition, in particular a liquid cosmetic composition, comprising solid particles responsive to a magnetic field, comprising:

- a container intended to contain the liquid composition;
- an applicator able to be mounted on the container and comprising a stem and an applicator head integral with one end of the stem, the stem and the applicator head being adapted for insertion into the container when the applicator is mounted on the container; and
- a stem cleaning member arranged in the container.

BACKGROUND OF THE DISCLOSURE

In the field of cosmetic devices, there are known devices of this type in which the liquid cosmetic composition comprises a liquid phase and solid particles such as pearlescent agents that may or may not be responsive to a magnetic field, the cosmetic composition being intended to be applied to the eyelashes, lips, nails, hair, or skin of a user.

Generally, when the solid particles are responsive to a magnetic field, then the applicator comprises a magnetic applicator head to enable better loading of the applicator head and/or to orient the solid particles to provide optical effects when the composition is applied, as described for example in patent FR 2,947,432 A1 in the name of the Applicant. Other devices comprise a magnet separate from the applicator as the magnetic part, used immediately after application of the composition to create patterns by orienting the solid particles via the effect of the magnetic field of the magnet, as described for example in patent FR 2,876,011 A1.

The case of solid particles that are not responsive to a magnetic field is more common, as this concerns a very large number of cosmetic formulations. It is widely known to use solid particles in a more or less viscous liquid composition which sometimes forms a paste, as with most mascaras for example. These solid particles are generally called "fillers" and they range from pearlescent agents to pigments, including some natural or synthetic fibers that are used to obtain various well-known effects.

However, the use of these solid particles, which may or may not be responsive to a magnetic field, encounters recurring and related technical issues concerning the maximum possible concentration of solid particles in a given composition, the possibility of being able to deposit the composition on a surface, as well as the drying out of such compositions which are typically relatively viscous and therefore particularly sensitive to this latter phenomenon.

Such compositions generally comprise at most about 10 to 15% (by weight) of solid particles. Beyond that, it becomes difficult to disperse them in a composition in a stable and homogeneous manner and to spread the composition on a surface, whether by hand or in the more difficult case by applicator where the applicator head must be sufficiently loaded with product.

In practice, if one wants to have a homogeneous composition comprising solid particles that remain stable because they have very little or no mobility in the composition and/or if one wants to use a higher concentration of solid particles, it must be possible to increase the viscosity of the composition.

To do so, thickeners are generally added to try to obtain the desired viscosity for a given composition.

If the viscosity of the composition is not correctly adjusted, clumps of solid particles will form when it is too high or the particles will settle to the bottom of the container when it is too low. If the formula is too thick, it becomes difficult to load the applicator head and spread the product. It is well known to consumers of cosmetics, particularly mascara, that it soon becomes necessary to use the applicator, particularly the stem and the applicator head, as an agitator the user moves back and forth within the container to render the composition more fluid for loading onto the applicator head. This practice is not without impact on the properties of the composition because it dries more quickly when in contact with the air, which causes its viscosity to increase more rapidly.

With use, it thus becomes more and more difficult, and eventually impossible, to maintain an optimal load of product containing solid particles on the applicator head. In the case of mascara, a significant percentage of the originally provided product becomes unusable and therefore lost.

SUMMARY OF THE DISCLOSURE

The present invention aims to overcome these disadvantages by providing a device that allows the application of a liquid composition comprising solid particles, including in very large amounts, which is as reproducible as possible and of a quality that remains as constant as possible over time, and is simple to use.

To this end, the invention relates to a device for packaging and applying a liquid composition comprising solid particles responsive to a magnetic field, of the aforementioned type, characterized in that the stem of the applicator comprises a magnetic part able to generate a magnetic field suitable for attracting and retaining on the stem, at least when in a rest position, at least a portion of said solid particles, said magnetic part extending over at least a portion of a region of the stem which extends between the applicator head and the cleaning member when the applicator is mounted on the container.

With these arrangements, the magnetic part of the stem can attract a sufficient amount, for the desired application, of solid particles responsive to a magnetic field which then accumulate on the applicator stem so as to cover the magnetic part with solid particles.

If solid particles are present in excess, they can settle at the bottom of the container due to their mobility in the liquid phase, escaping the influence of the magnetic field of the magnetic part. This excess of solid particles can also serve as a reserve for future use, enabling optimal prolonged usage by fixing an effective amount of solid particles to the magnetic part of the stem for as long of a period as possible.

Finally, when the applicator is withdrawn from the container, the solid particles accumulated on the stem are released by contact with the cleaning member, said solid particles then locally and temporarily changing the viscosity of the liquid phase around the stem and especially around the applicator head.

The device of the invention allows, at each use, temporarily and locally modifying the viscosity of the composition as it is applied, which offers many advantages.

First, it allows loading the applicator head with a cosmetic composition comprising a significant and reproducible amount of solid particles dispersed in a liquid phase of a higher viscosity better suited for application to a surface, particularly in the context of usage in cosmetics, and more particularly on keratin fibers.

Moreover, with this increase in viscosity, which depends on the volume fraction of the solid particles dispersed in the liquid phase as occurs only when the applicator head is loaded for use, it is possible to use a liquid phase of lower viscosity. Such a liquid phase allows adding a distinctly larger amount of solid particles than the amounts known in the prior art, and allows providing a packaging and application device that is significantly less sensitive to the drying phenomenon.

In preferred embodiments of the invention, one or more of the following arrangements may possibly be used:

- the magnetic part extends discontinuously over at least a portion of said region of the stem;
- the magnetic part extends continuously over at least a portion of said region of the stem;
- the magnetic part extends over the entirety of said region of the stem;
- the applicator stem is at least partially hollow, the magnetic part comprising at least one solid magnet arranged within the stem;
- the magnetic part is composed of magnetic or magnetizable particles embedded in a component material of the stem;
- the magnetic part is able to generate a magnetic field gradient oriented along a longitudinal axis of the stem;
- the liquid composition comprises a liquid phase, the liquid phase and the container being transparent and/or translucent;
- the liquid composition comprises a liquid phase which is an aqueous dispersion of said solid particles in a water-soluble or water-dispersible acrylic- and/or polyacrylic-type film-forming polymer or a mixture of such film-forming polymers;
- the aqueous dispersion comprises, in percent by weight relative to the total weight of the aqueous dispersion:
  - QS water;
  - 5 to 90% of at least one polymer or of a mixture of acrylate- and/or polyacrylate-type polymers as film-forming agent, preferably 20 to 50%, more preferably 30 to 40%; and optionally
  - 1 to 30% of at least one $C_6$-sugar or $C_{12}$-sugar as a plasticizer, preferably 5 to 15%; and/or
  - 0 to 15% ethyl alcohol;
- the liquid composition comprises, in percent by weight relative to the total weight of the liquid composition:
  - QS water;
  - 5 to 90% of at least one polymer or of a mixture of acrylate- and/or polyacrylate-type polymers as film-forming agent, preferably 20 to 50%, more preferably 30 to 40%;
  - 0.5 to 50% of solid particles responsive to a magnetic field, preferably 0.5 to 20%, more preferably 10 to 15%; and optionally
  - 1 to 30% of at least one $C_6$-sugar or $C_{12}$-sugar as a plasticizer, preferably 5 to 15%; and/or
  - 0 to 15% ethyl alcohol; and
- the liquid composition is a cosmetic composition, preferably a mascara.

The invention also relates to the use of a device as described above for application of the liquid cosmetic composition to a part of the human body, preferably the eyelashes.

In particular, mascara is applied to the eyelashes by means of a device as described above.

The invention further relates to a method for applying a liquid cosmetic composition to a part of the human body by using a device as described above, the method comprising the steps of:

- withdrawing the applicator from the container;
- applying the cosmetic composition to a part of the human body; and
- inserting the applicator into the container.

The invention also relates to a makeup kit for the eyelashes, comprising a first device for applying a first mascara and a second device as described above containing a second mascara.

BRIEF DESCRIPTION OF DRAWINGS

The invention will be better understood by reading the following description of various embodiments of the invention, given only by way of example, with reference to the accompanying drawings in which.

DETAILED DESCRIPTION OF THE DISCLOSURE

In the various figures, identical references are used to indicate identical or similar elements.

Figure 1:
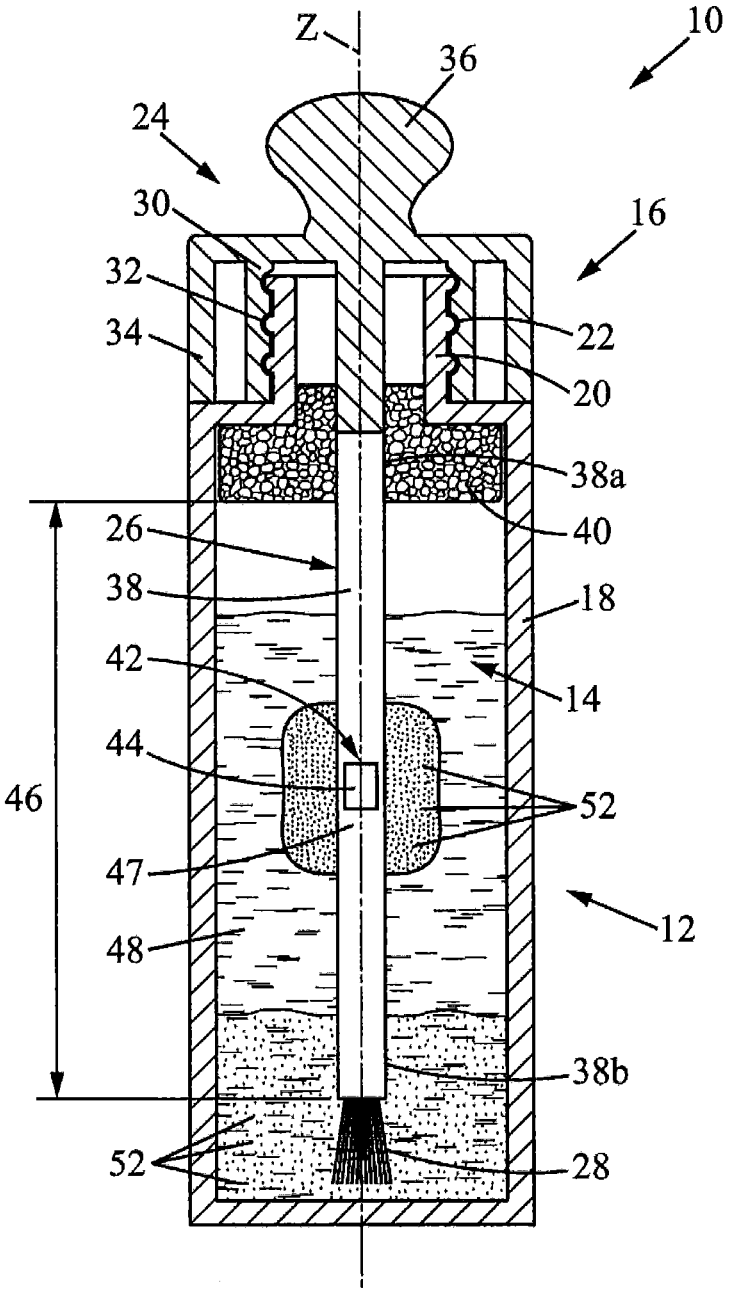
FIG. 1 is a vertical sectional view of a device according to a first embodiment of the invention, in an initial rest position.

FIG. 1 illustrates a device 10 for packaging and applying a liquid composition according to a first embodiment of the invention, in an initial rest position where it is not in use, the liquid composition comprising solid particles responsive to a magnetic field and here being mascara intended for application to a user's eyelashes.

The device 10 comprises a container 12 containing the mascara 14, and an applicator 16 mounted on the container 12.

The container 12 comprises a body 18 and a neck 20 extending the body 18 but narrowed relative to the body 18.

In the example, the body 18 has a substantially cylindrical shape of axis Z and a substantially square cross-section.

The neck 20, which has a substantially cylindrical shape of axis Z and a substantially circular cross-section, has an external thread 22.

Advantageously, the container 12 is manufactured from a substantially transparent or translucent material, for example a glass or a plastic such as polyethylene terephthalate (PET) or a polyamide (PA).

The applicator 16 comprises a cap 24, a stem 26, and an applicator head 28.

The cap 24 comprises an inner skirt 30 of substantially cylindrical shape of axis Z and of substantially circular cross-section and provided with an internal thread 32 complementary to the external thread 22 of the neck 20 so that the cap 24 can be screwed on the neck 20 and seal the container 12.

The inner skirt 30 is surrounded by an outer skirt 34 of substantially cylindrical shape of axis Z and having a cross-section identical to that of the body 18. The presence of the outer skirt 34 is optional, as this skirt has a mainly aesthetic function.

A gripping member 36 is mounted on top of the inner 30 and outer 34 skirts.

The stem 26 comprises a hollow tube 38 which extends between the cap 24 and the applicator head 28 and is inserted into the container 12 when the cap 24 is sealing the container 12. In particular, the tube 38 extends along axis Z between a proximal end 38*a* and a distal end 38*b*, and has for example a substantially circular and constant cross-section along axis Z.

The tube 38 has, for example, a length substantially equal to 50 mm and an outer diameter substantially equal to 4.4 mm.

The proximal end 38*a* of the tube 38 is integral with the cap 24 while the applicator head 28 is integral with the distal end 38*b*.

In the embodiment described here, the applicator head 28 is formed by a bundle of bristles forming a brush tip.

Alternatively, the applicator head may be formed by a comb, a lateral brush, a foam, a threaded tip, a flocked tip, or any other means adapted to exert a similar function.

The device 10 comprises a cleaning member 40 for cleaning the stem 26, arranged in the container 12 at the narrowing between the body 18 and the neck 20. The cleaning member 40 serves to release solid particles located on the stem 26 of the applicator 16 when the latter is withdrawn from the container 12 as will be explained in more detail below, thereby stirring the solid particles into the liquid phase of the cosmetic composition, in this example mascara 14, around the stem 26 and applicator head 28. With these arrangements, the viscosity of the liquid composition is temporarily and locally increased which helps to load the applicator head 28 with solid particles and to reduce the phenomena that cause the cosmetic composition to dry out.

In a preferred embodiment, the cleaning member 40 is a sleeve inserted into the neck 20 of the container 12 and made from a relatively flexible material that seals the neck 20 and is elastically deformed by the passage of the applicator 16.

In the example, the cleaning member 40 is made of flexible foam but it is possible to use any type of scraper conventionally used in cosmetics.

Alternatively, the cleaning member 40 may be formed directly by the neck 20 of the container 12.

In order to be able to store temporarily on the stem 26 some of the solid particles contained in the mascara 14, the stem 26 comprises a magnetic part 42 able to generate a magnetic field suitable for attracting and retaining on the stem, at least when in the rest position, at least a portion of the solid particles.

"Magnetic part" is understood to mean a part able to generate a magnetic field, whether it is magnetized or magnetizable.

The magnetic part 42 is located between the cap 24 and the applicator head 28. More particularly, the magnetic part 42 extends over at least a portion of a region 46 of the stem 26 which extends between the applicator head 28 and the cleaning member 40 when the applicator 16 is mounted on the container 12.

In the first embodiment of FIG. 1, the magnetic part 42 comprises a solid magnet 44 arranged on a central section 47 of the region 46 of the stem 26. The magnetic part is then considered to extend continuously over only a portion of the region 46 of the stem 26.

The magnet 44 has a substantially cylindrical shape, for example of a length between 10 and 12 mm, and a substantially circular cross-section, for example 2 mm in diameter. Alternatively, the magnet 44 may have any suitable shape, for example rectangular, triangular, etc.

The magnet 44 may be fitted into or glued to the inside of the tube 38.

Alternatively, the magnet 44 is overmolded when the stem 26 is manufactured.

The magnet 44 is preferably a permanent magnet made from ferromagnetic material or from a material comprising magnetic or magnetizable particles.

The term "magnetic or magnetizable particles" is understood to mean particles having a non-zero magnetic susceptibility, meaning they are responsive to the action of a magnetic field.

The magnet 44 is able to generate a magnetic field which may or may not be oriented along axis Z.

The cosmetic composition 14 comprises a liquid phase 48 and solid particles 52 responsive to a magnetic field.

The liquid phase 48 is an aqueous dispersion of said solid particles 52 in a water-soluble or water-dispersible acrylic- and/or polyacrylic-type film-forming polymer or a mixture of such film-forming polymers.

Generally, the aqueous dispersion comprises, in percent by weight relative to the total weight of the aqueous dispersion:

QS water;

5 to 90% of at least one polymer or of a mixture of acrylate- and/or polyacrylate-type polymers as film-forming agent, preferably 20 to 50%, more preferably 30 to 40%; and optionally 1 to 30% of at least one $C_6$-sugar or $C_{12}$-sugar as a plasticizer, preferably 5 to 15%; and/or 0 to 15% ethyl alcohol.

The liquid phase 48 has a viscosity of between $5\times10^{-3}$ Pa·s and $5\times10^{-1}$ Pa·s, these values having been obtained by rheological measurements performed on an ARES-G2 rheometer at a speed of 100 $cm^{-1}$ and in a 30 mL tank with vanes. This range of viscosities therefore excludes pasty cosmetic compositions in which solid particles are stably dispersed and thus substantially immobile and able to contain a higher concentration of solid particles.

The liquid phase 48 thus comprises water, a film-forming polymer, a sugar-type plasticizer, an alcohol, and a preservative.

The polymer is essential to creating a film on the eyelashes. It may be chosen from among the water-soluble or water-dispersible polymers such as latex which are acrylate/polyacrylate-type film-forming polymers, vinylpyrrolidone polymers and copolymers, and polyvinyl alcohols, or more generally from among the entire acrylics family. Of course, it may also be a mixture of film-forming polymers. Preferably, the chosen polymer is generally transparent so that the solid particles are clearly visible, thus improving the aesthetics of the product. Such polymers may be, for example, those sold under the names Syntran®, Covacryl®, Ultrasol®, and Daitosol®.

The plasticizer is essential or optional depending on the nature of the polymer. In order to have a useful film, it is essential to have a plasticizer associated with the film-forming polymer. The plasticizer may be a polyol which can be selected from among the sugars and their derivatives, particularly their esters or their ethers. The sugar is, for example, selected from among $C_6$-sugars and $C_{12}$-sugars. A $C_6$-sugar can be glucose, sorbitol, mannitol, or galactitol. A $C_{12}$-sugar can be sucrose or lactitol. The polyol may be selected from among the polyalkylene glycols, particularly $C_2$-$C_5$ polyoxyalkylene and more particularly polyethylene oxide and/or polypropylene oxide. The polyol is preferably selected from among glycerol, sorbitol, and the glycols. In an advantageous embodiment, the polyol is sorbitol, for 112 when the device 110 is in the rest position. 0/02®. Ethyl alcohol is not essential but its presence accelerates the drying of the composition.

A preservative is highly recommended. The ones most commonly used are phenoxyethanol and also the methyl, ethyl, propyl, or butyl para-hydroxybenzoates and sorbic acid.

Thus, in general, the liquid composition 14 comprises, in percent by weight relative to the total weight of the liquid composition 14:

QS water;

5 to 90% of at least one polymer or of a mixture of acrylate- and/or polyacrylate-type polymers as film-forming agent, preferably 20 to 50%, more preferably 30 to 40%;

0.5 to 50% of solids particles 52 responsive to a magnetic field, preferably 0.5 to 20%, more preferably 10 to 15%; and optionally 1 to 30% of at least one C6-sugar or $C_{12}$-sugar as a plasticizer, preferably 5 to 15%; and/or 0 to 15% ethyl alcohol.

The solid particles 52 are magnetic or magnetizable particles which are responsive to a magnetic field and which are adapted to be attracted by the magnet 44.

The solid particles 52 may comprise any magnetic material such as nickel, cobalt, iron, their alloys and oxides, in particular iron oxide $Fe_3O_4$.

Advantageously, the solid particles 52 also have optical properties of light diffraction and/or reflection, in particular when the liquid phase 48 is transparent or translucent.

Preferably, the solid particles 52 are magnetic pearlescent agents comprising iron oxide $Fe_3O_4$. For example, the following combinations are possible: mica/iron oxide, mica/titanium/iron oxide, borosilicate/iron oxide, borosilicate/titanium/iron oxide, silica/iron oxide, aluminum/silica/iron oxide, and alumina/iron oxide. Such pearlescent agents are, for example, sold under the names Colorona Blackstar®, Cloisonne Nu-Antique®, Sunpearl Shadow®, Reflecks Blackened®, Sunprizma®, Mica BLACK®.

The particle size of the solid particles 52 is between 0.1 and 700 μm.

The liquid composition 14 may be obtained by dispersing the various items using a Rayneri mixer. In a first phase, the water, the polymer, the plasticizer, the alcohol, and the preservative are mixed at 350 rpm for 30 minutes. When the obtained phase is homogeneous, the pearlescent agents are added at 350 rpm and this is mixed for 10 minutes. Prior to this procedure, if the plasticizer is a sugar, it may be necessary to heat it initially if it is slightly crystallized in order to return it to a more uniform state.

Alternatively, the solid particles 52 may be fibers loaded with iron oxide.

The magnetic properties of the magnet 44 are advantageously chosen according to the viscosity of the medium, the nature or composition of the solid particles 52, their magnetic sensitivity, and/or their concentration, so as to exert on the solid particles 52 an attractive force sufficient to attract and retain them on the stem 26 at least when the stem 26 is at rest in the container 12.

EXAMPLES

Examples of liquid compositions with different types of pearlescent agents are given in Table 1 below. These compositions are transparent because they are based on a transparent polymer.

TABLE 1

| INCI NAME | TRADE NAME | % WEIGHT |
|---|---|---|
| WATER | PURIFIED WATER | 45.34 |
| WATER AND ACRYLIC COPOLYMER AND PHENOXYETHANOL | COVACRYL A15 WP | 28.57 |
| SORBITOL | NEOSORB 70/02 | 9.52 |
| CALCIUM SODIUM BOROSILICATE + IRON OXIDES | REFLECKS DIM. SPARKL. BLACKENED GOLD | 7.15 |
| MICA + IRON OXIDES | COLORONA BLACKSTAR GOLD | 7.15 |
| PHENOXYETHANOL | PHENOXETOL | 0.85 |
| ALCOHOL | ALCOHOL, 96.2% VOL KG | 1.42 |
| WATER | PURIFIED WATER | 49.21 |
| WATER AND ACRYLIC COPOLYMER AND PHENOXYETHANOL | COVACRYL A15 WP | 30 |
| SORBITOL | NEOSORB 70/02 | 9.52 |
| CALCIUM SODIUM BOROSILICATE + IRON OXIDES | REFLECKS DIM. SPARKL. BLACKENED RED | 4 |
| MICA AND TITANIUM DIOXIDE AND IRON OXIDES | SUNPRIZMA CONCORD CRUSH C90-7241 | 5 |
| PHENOXYETHANOL | PHENOXETOL | 0.85 |
| ALCOHOL | ALCOHOL, 96.2% VOL KG | 1.42 |
| WATER | PURIFIED WATER | 38.21 |
| WATER AND ACRYLIC COPOLYMER AND PHENOXYETHANOL | COVACRYL A15 WP | 32 |
| SORBITOL | NEOSORB 70/02 | 9.52 |
| MIXTURE OF IRON OXIDES, MICA, AND TITANIUM DIOXIDE | COLORONA MICA BLACK | 10 |
| MICA AND TITANIUM DIOXIDE AND IRON OXIDES | SUNPEARL SHADOW BLUE | 8 |
| PHENOXYETHANOL | PHENOXETOL | 0.85 |
| ALCOHOL | ALCOHOL, 96.2% VOL KG | 1.42 |

Other examples of liquid compositions with different types of pearlescent agents are given in the following Table 2, but these compositions are not transparent.

TABLE 2

| INCI NAME | TRADE NAME | % WEIGHT |
|---|---|---|
| WATER | PURIFIED WATER | 45.34 |
| WATER AND ACRYLIC COPOLYMER AND PHENOXYETHANOL | COVACRYL E14 WP | 28.57 |

TABLE 2-continued

| INCI NAME | TRADE NAME | % WEIGHT |
|---|---|---|
| SORBITOL | NEOSORB 70/02 | 9.52 |
| CALCIUM SODIUM BOROSILICATE + IRON OXIDES | REFLECKS DIM. SPARKL. BLACKENED GOLD | 7.15 |
| MICA + IRON OXIDES | COLORONA BLACKSTAR GOLD | 7.15 |
| PHENOXYETHANOL | PHENOXETOL | 0.85 |
| ALCOHOL | ALCOHOL, 96.2% VOL KG | 1.42 |
| WATER | PURIFIED WATER | 38.21 |
| WATER AND STYRENE/ACRYLATE/ AMMONIUM METHACRYLATE COPOLYMER AND BUTYLENE GLYCOL SODIUM LAURETH-12 SULFATE | SYNTRAN 5660 CG | 32 |
| SORBITOL | NEOSORB 70/02 | 9.52 |
| MIXTURE OF IRON OXIDES, MICA, AND TITANIUM DIOXIDE | COLORONA MICA BLACK | 10 |
| MICA AND TITANIUM DOXIDE AND IRON OXIDES | SUNPEARL SHADOW BLUE | 8 |
| PHENOXYETHANOL | PHENOXETOL | 0.85 |
| ALCOHOL | ALCOHOL, 96.2% VOL KG | 1.42 |

The operation of the device 10 is explained below.

Initially, the device 10 is in the initial rest position prior to use, as illustrated in FIG. 1.

In this position, the cap 24 is screwed onto the neck 20 and seals the container 12.

The stem 26 and the applicator head 28 are immersed in the mascara 14.

A portion of the solid particles 52 has clustered on the stem 26 at the magnet 44, while the other solid particles 52 rest at the bottom of the container 12.

When a user wishes to apply mascara to the eyelashes 14, she grasps the gripping member 36, unscrews the cap 24, and withdraws the stem 26 from the container 12 without having to shake it immediately prior to the first use.

The stem 26, integral with the cap 24, is thus displaced at least in translation relative to the container 12.

Figure 2:
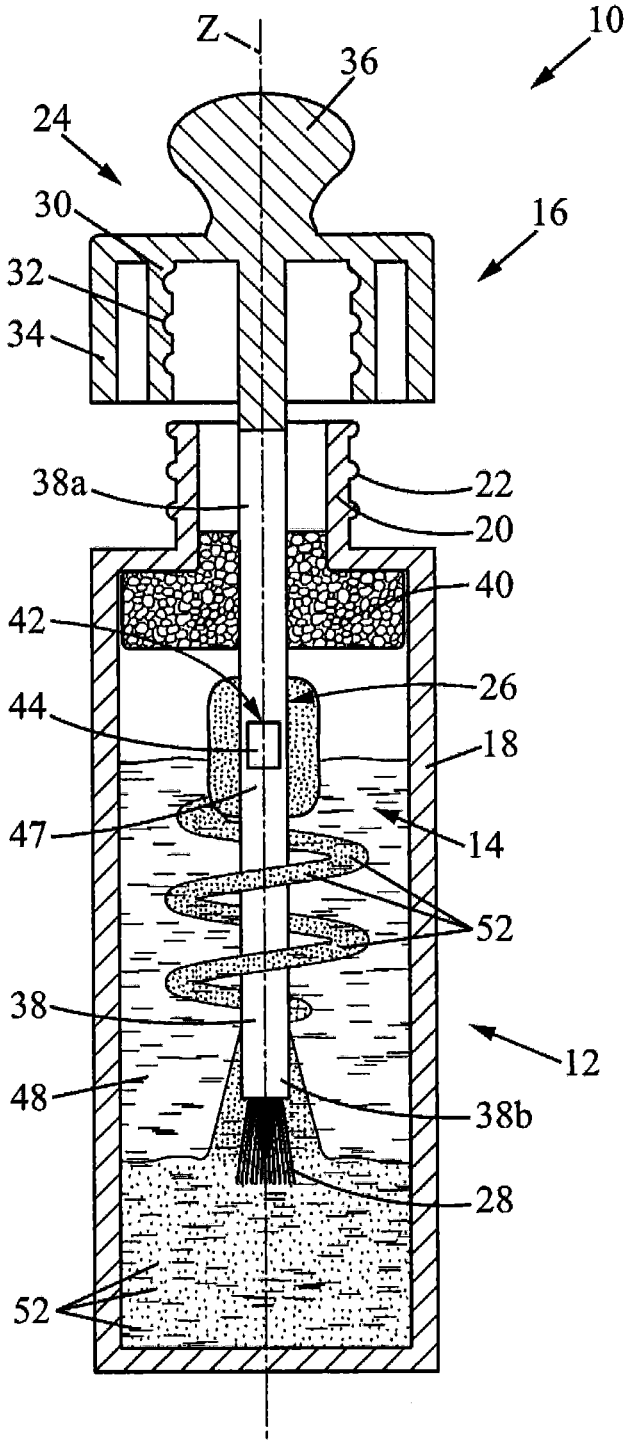
FIG. 2 is a view identical to that of FIG. 1, in a first intermediate position during withdrawal.

As illustrated in FIG. 2, the translational and here also rotational movement of the stem 26 releases a portion of the solid particles 52 that have accumulated at the magnet 44, generating a "vortex" of solid particles 52 which swirls substantially about axis Z near the stem 26 and therefore next to the applicator head 28 when withdrawing the applicator 16 from the container 12.

The magnetic properties of the magnet 44 can thus also be chosen so that displacement of the stem 26 relative to the container 12 causes the release of solid particles 52 attracted to the stem 26. This is particularly suitable when the container and the composition are transparent and/or translucent, creating visual effects in the container 12.

When the cap 24 is completely unscrewed from the container 12, the user continues the movement of withdrawing the applicator 16 from the container 12 by moving the applicator 16 along axis Z.

Figure 3:
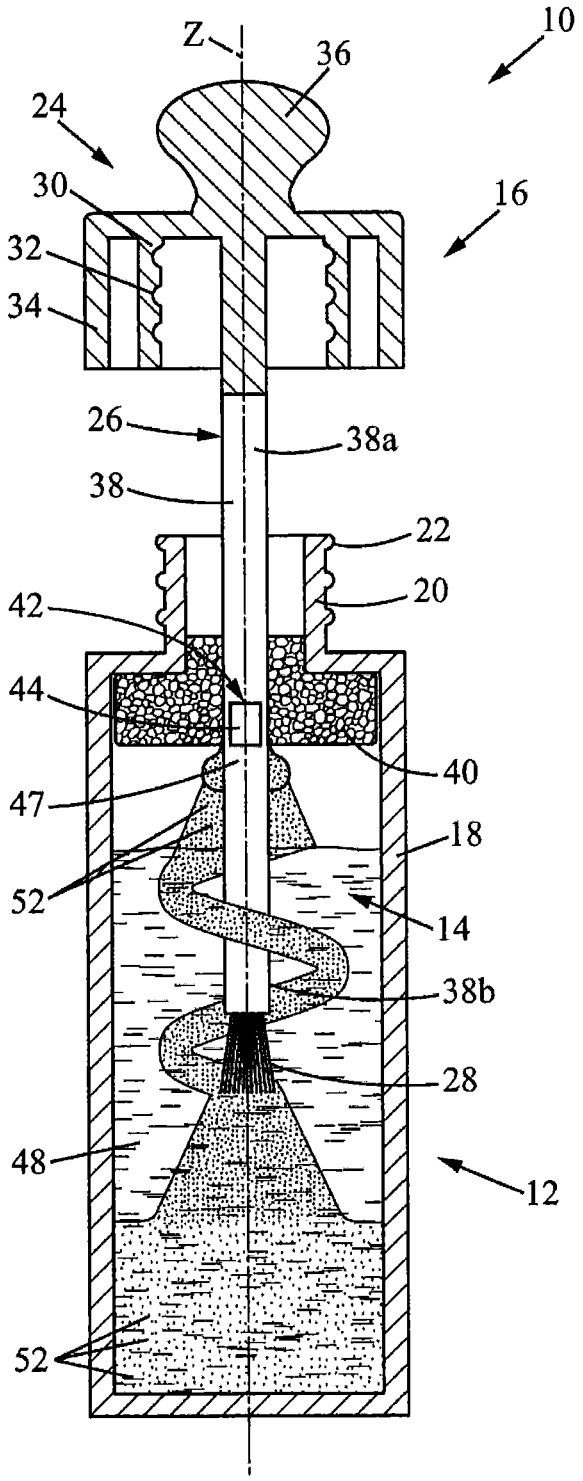
FIG. 3 is a view identical to that of FIG. 1, in a second intermediate position during withdrawal.

The passage of the stem 26 through the cleaning member 40 frees the solid particles 52 that have accumulated on the magnet 44 and have not been released by the rotation of the stem 26. These solid particles 52 then fall into the liquid phase 48 of the mascara 14 in a rain of solid particles 52 (FIG. 3).

All the solid particles 52 which have accumulated on the stem 26 at the magnet 44 are thus dispersed into the liquid phase 48 of the mascara 14 near the stem 26 and applicator head 28, and thus temporarily form, in the liquid phase 48, a phase of a viscosity that is substantially increased due to the presence of a large quantity of solid particles 52.

Figure 4:
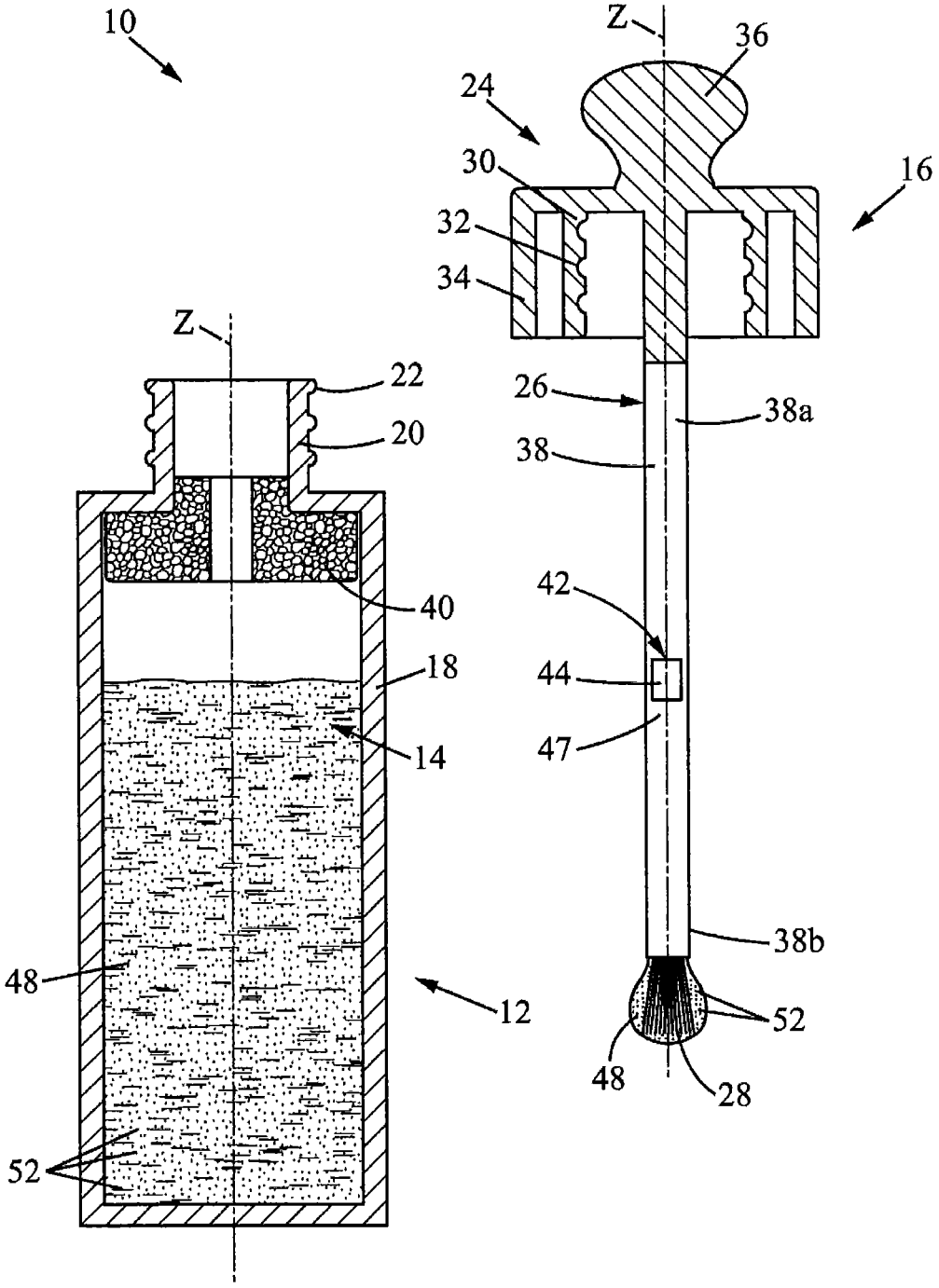
FIG. 4 is a view identical to that of FIG. 1, in a final position with the applicator ready for use.

The applicator head 28 then passes through this cloud of solid particles 52 and is loaded with the mascara that has just been mixed and can thus be applied by the user to the eyelashes (FIG. 4). The user can be considered to have temporarily adjusted the viscosity of the liquid composition 14 near the applicator head 28, in order to optimize the loading of the applicator head 28 with an optimal and reproducible amount of solid particles 52.

With these arrangements, an optimal sample of solid particles 52 is guaranteed to be collected at each use, providing a more uniform aesthetic effect over time and preserving the application potential of the remaining composition by limiting its degradation, unlike devices of the prior art in which the concentration of solid particles increases when too much liquid composition and not enough solid particles are collected at each use, the particles ultimately being lost.

When finished applying the mascara, the user inserts the applicator head 28 and stem 26 into the container and screws the cap 24 onto the neck 20.

A portion of the solid particles 52 still suspended in the liquid phase is attracted by the magnet 44 and clusters on the stem 26, while the rest of the solid particles 52 falls to the bottom of the container 12. The device 10 is once again in the rest position illustrated in FIG. 1, but with less mascara 14.

The device 10 may be sold alone or may be part of a makeup kit for the eyelashes. Such a kit may comprise a first device for applying and packaging a first mascara serving as a mascara base coat, and a second device for packaging and applying according to the invention containing a second mascara serving as a mascara top coat.

Figure 5:
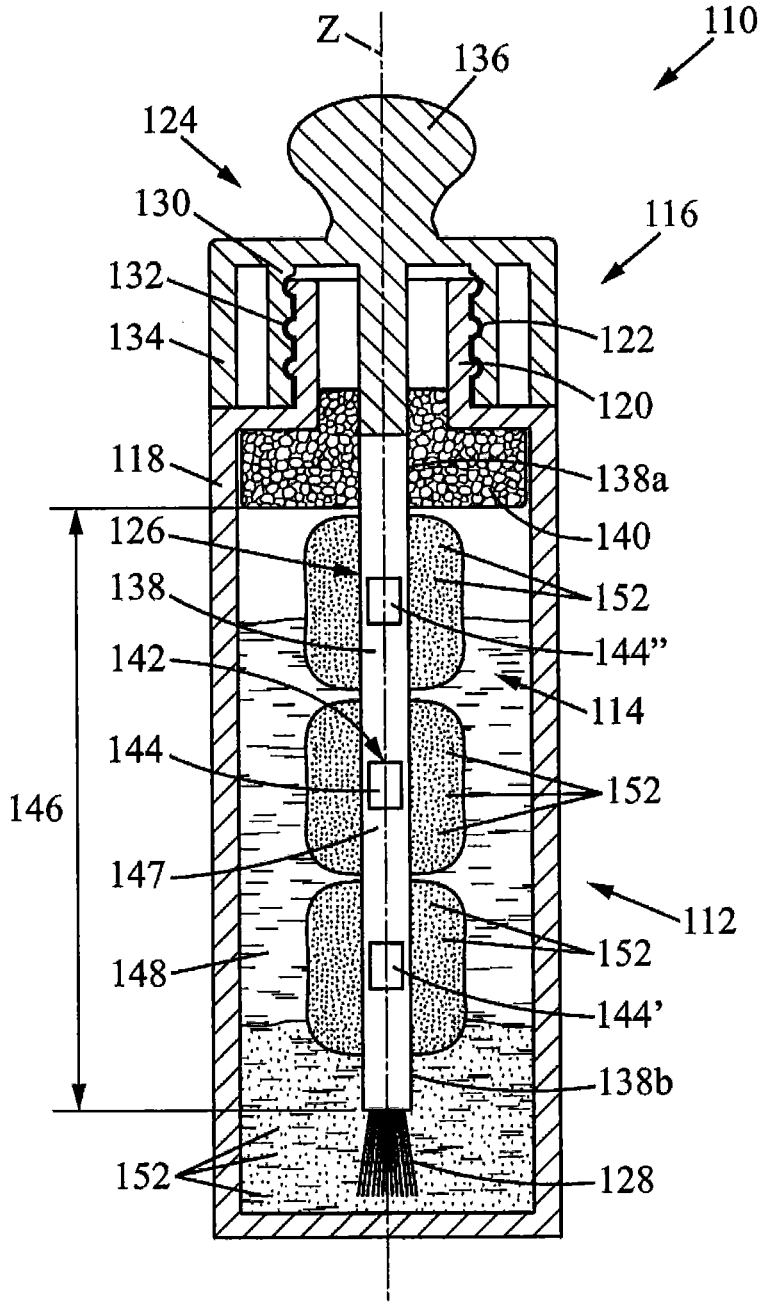
FIG. 5 is a view identical to that of FIG. 1, illustrating a device according to a second embodiment of the invention in an initial rest position.

FIG. 5 illustrates a device 110 for packaging and applying a liquid composition according to a second embodiment of the invention.

This second embodiment of the invention differs from the first embodiment of FIGS. 1 to 4 in that the magnetic part 142 of the stem 126 comprises three magnets that are identical to one another: a central magnet 144 arranged on the central section 147 of the region 146 of the stem 126, and two end magnets 144', 144" arranged on either side of the central magnet 144 and substantially equidistant from the central magnet 144. The magnetic part 142 is then considered to extend over the entire region 146 of the stem 126 in a discontinuous manner.

The solid particles 152 are therefore accumulated on the stem 126 in three different locations, thus creating a pattern inside the container 112 when the device 110 is in the rest position.

As the liquid phase 148 of the mascara 114 and the body 118 of the container 112 are transparent and/or translucent, this pattern is visible to the user.

The solid particles 152 are therefore always visible to the user, whether inside the container 112 or on the eyelashes.

Alternatively, the magnetic part 142 comprises a different number of magnets, for example two, four, or more, which may be arranged relative to each other in any manner along the region 146 of the stem 126.

Figure 6:
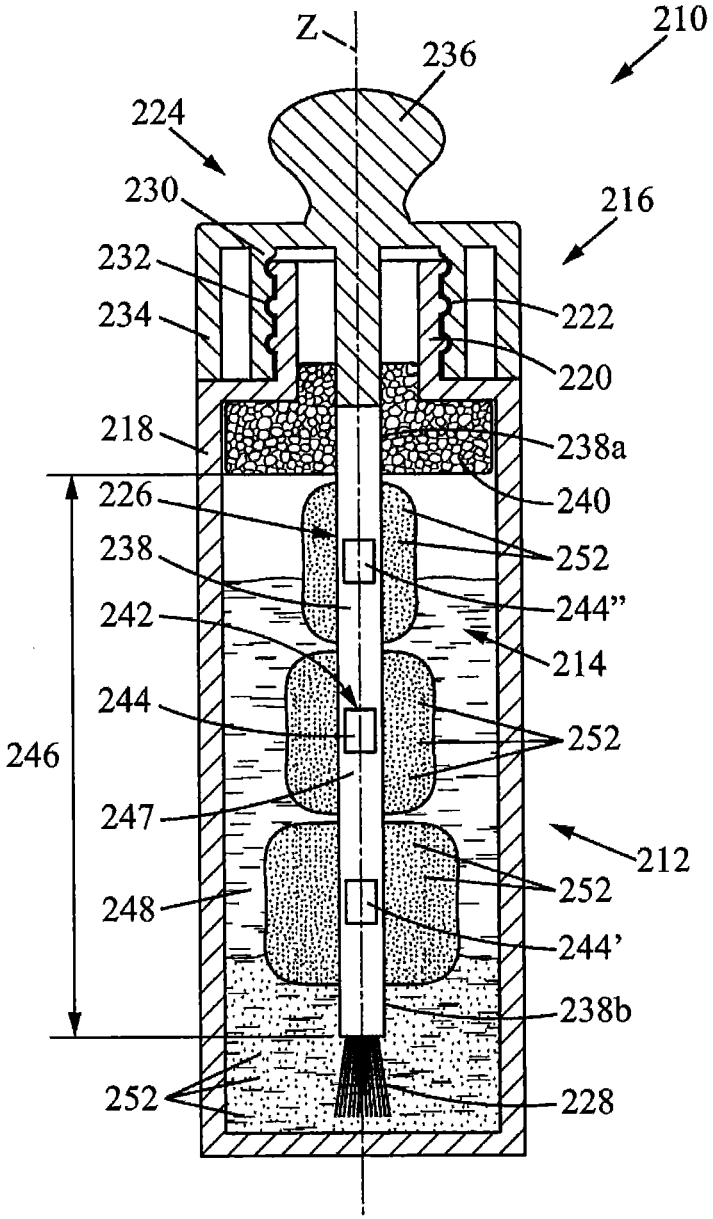
FIG. 6 is a view identical to that of FIG. 1, illustrating a device according to a third embodiment of the invention in an initial rest position.

FIG. 6 illustrates a device 210 for packaging and applying a liquid composition according to a third embodiment of the invention.

This third embodiment of the invention differs from the second embodiment of FIG. 5 in that the attractive forces of the three magnets 244, 244', 244" differ from one another.

Here, the attractive force of the distal magnet 244" is greater than that of the central magnet 244, which is itself greater than that of the proximal magnet 244', thereby creating a magnetic field gradient oriented along the longitudinal axis Z of the stem 226 and toward its distal end 238*b*.

Alternatively, it is possible to create a magnetic field gradient with magnets of different sizes. Or the magnetic field lines can be exploited to create patterns.

Depending on the number of magnets, their size, their position on the stem, their attractive force, and the orientation of each magnetic field, the solid particles will accumulate on the stem in different ways from one device to another. It is thus possible to create a huge number of different patterns for the device.

In a fourth embodiment of the invention, the magnetic part is composed of magnetic or magnetizable particles embedded in a component material of the stem. For example, the stem may be made using a rare earth magnet, for example of neodymium, or of a magnetizable plastic, the plastic being magnetized in the forming mold, and overmolded with a protective skin acting as a barrier between the liquid composition and the stem.

These particles may be localized to one or more predetermined locations in the stem region, for example in its central section and/or at its ends, and may have different concentrations between one location of the stem region and another.

Alternatively, the particles may be distributed uniformly over the entire length of the stem region, meaning in a substantially constant concentration along the stem region, or non-uniformly, meaning in a variable concentration along the stem region. The magnetic part is then considered to extend continuously along substantially the entire length of the stem region.

It is thus possible to create a large number of different patterns for the device depending on the position and/or the concentration of the magnetic or magnetizable particles forming the stem.

The stem is, for example, obtained by injection or bi-injection of plastic loaded with magnetized particles.

In a fifth embodiment of the invention, the applicator head also comprises a magnetic part able to attract the solid particles of the cosmetic composition. For example, the applicator head may comprise a magnet. Alternatively, the applicator head comprises a metal tip covered with flocking and connected by a wire to a central magnet provided in the stem.

The invention therefore proposes a device for packaging and applying a liquid composition, in particular cosmetic, which is simple to use and which when applied provides satisfactory results and the desired visual effect.

Indeed, the simple act of unscrewing the cap combined with withdrawing the stem through the cleaning member allows locally and temporarily changing the viscosity of the cosmetic composition to achieve better loading of the applicator head with solid particles without requiring a shaking step as known in the prior art and which is detrimental. The conventional gesture of a mascara user is thus changed.

In particular, with the device according to the invention, it is unnecessary to shake the container or to "pump" the stem, meaning to move the applicator in and out in order to stir the cosmetic composition immediately prior to application. This not only simplifies the use of the device, but also prolongs the life of the cosmetic composition by reducing the introduction of air into the container, thus reducing the drying out of the cosmetic composition over time, which is a major problem for any cosmetic composition and in particular for mascara.

In addition, by reducing the drying out of the cosmetic composition, this not only reduces the loss of product but also the clogging of the applicator head. With the invention, the more viscous product remaining after application is placed back in the substantially greater amount of a markedly less viscous liquid phase, which returns the product to a lower viscosity value and thus "cleans" the applicator head to a certain extent. An applicator head is thus provided having properties that do not degrade or that do so much more slowly because the device is returned to an initial state after each use due to the mobility of the solid particles.

With the device according to the invention it is also possible to eliminate thickeners, which are no longer needed. These thickeners, in particular waxes, render the composition more dull. It is therefore possible with the invention to eliminate this problem and to have a bright composition. This plays an important role in colored compositions and in providing optical effects such as the reflection/refraction phenomena caused by certain solid particles such as pearlescent agents.

Moreover, as the cosmetic composition has a liquid phase, the device according to the invention not only allows applying the cosmetic composition in an optimal manner, in particular in the form of a film, but also makes the solid particles visible, creating a satisfactory visual effect and look.

In addition, the device has a surprising and attractive appearance when at rest, which can be adapted via the composition, position, and magnetic properties of the magnetic part.

The invention has been described with reference to mascara as the cosmetic composition and to eyelashes as the application, but it is quite possible to use the invention for other applications, such as mascara for the hair and more generally for all keratin fibers, nail polish, liquid lipstick, lip gloss, etc.

The invention claimed is:

1. A device for packaging and applying a liquid composition, comprising:

a container containing a liquid composition comprising solid particles responsive to a magnetic field;

an applicator able to be mounted on the container and comprising a stem and an applicator head integral with one end of the stem, the stem, and the applicator head being adapted for insertion into the container when the applicator is mounted on the container; and a cleaning member for cleaning the stem, arranged in the container, wherein the stem of the applicator comprises a magnetic part able to generate a magnetic field suitable for attracting and retaining on the stem, at least when in a rest position, at least a portion of said solid particles, said magnetic part extending over at least a portion of a region of the stem which extends between the applicator head and the cleaning member when the applicator is mounted on the container, and in that the liquid composition comprises a liquid phase that is transparent or translucent.

2. The device according to claim 1, wherein the magnetic part extends discontinuously over at least a portion of said region of the stem.

3. The device according to claim 1, wherein the magnetic part extends continuously over at least a portion of said region of the stem.

4. The device according to claim 1, wherein the magnetic part extends over the entirety of said region of the stem.

5. The device according to claim 1, wherein the stem of the applicator is at least partially hollow, the magnetic part comprising at least one solid magnet arranged within the stem.

6. The device according to claim 1, wherein the magnetic part is composed of magnetic or magnetizable particles embedded in a component material of the stem.

7. The device according to claim 1, wherein the magnetic part is able to generate a magnetic field gradient oriented along a longitudinal axis of the stem.

8. The device according to claim 1, wherein the container is transparent or translucent.

9. The device according to claim 1, wherein the liquid composition comprises a liquid phase which is an aqueous dispersion of said solid particles in a water-soluble or water-dispersible acrylic- and/or polyacrylic-type film-forming polymer or a mixture of such film-forming polymers.

10. The device according to claim 9, wherein the aqueous dispersion comprises, in percent by weight relative to the total weight of the aqueous dispersion:

QS water;

5 to 90% of at least one polymer or of a mixture of acrylate- and/or polyacrylate-type polymers as film-forming agent, preferably 20 to 50%, more preferably 30 to 40%; and optionally 1 to 30% of at least one $C_6$-sugar or $C_{12}$-sugar as a plasticizer, preferably 5 to 15%; and/or 0 to 15% ethyl alcohol.

11. The device according to claim 1, wherein the liquid composition comprises, in percent by weight relative to the total weight of the liquid composition;

QS water;

5 to 90% of at least one polymer or of a mixture of acrylate- and/or polyacrylate-type polymers as film-forming agent, preferably 20 to 50%, more preferably 30 to 40%;

0.5 to 50% of solid particles responsive to a magnetic field, preferably 0.5 to 20%, more preferably 10 to 15%; and optionally 1 to 30% of at least one $C_6$-sugar or $C_{12}$-sugar as a plasticizer, preferably 5 to 15%; and/or 0 to 15% ethyl alcohol.

12. The device according to claim 1, wherein the liquid composition is a cosmetic composition.

13. A method of using a device according to claim 12, including a step of applying liquid cosmetic composition with said applicator head of said device to a part of the human body.

14. A method of using a device according to claim 13, wherein said part of the human body is eyelashes.

15. A method according to claim 13, wherein the liquid cosmetic is a mascara and wherein said part of the human body is eyelashes.

16. A method for applying a liquid cosmetic composition to a part of the human body by using a device according to claim 12, the method comprising the following steps:

withdrawing the applicator from the container;

applying the cosmetic composition to a part of the human body; and inserting the applicator into the container.

17. A makeup kit for the eyelashes, comprising a first device for applying a first mascara and a second device according to claim 12 containing a second mascara.

18. A device according to claim 12, wherein the liquid composition is a mascara.

* * * * *